US007470876B2

(12) United States Patent
Drozd et al.

(10) Patent No.: US 7,470,876 B2
(45) Date of Patent: Dec. 30, 2008

(54) WAVEGUIDE EXPOSURE CHAMBER FOR HEATING AND DRYING MATERIAL

(75) Inventors: Esther Drozd, Cary, NC (US); J. Michael Drozd, Raleigh, NC (US)

(73) Assignee: Industrial Microwave Systems, L.L.C., Morrisville, NC (US)

( * ) Notice: Subject to any disclaimer, the term of this patent is extended or adjusted under 35 U.S.C. 154(b) by 180 days.

(21) Appl. No.: 11/306,025

(22) Filed: Dec. 14, 2005

(65) Prior Publication Data

US 2007/0131678 A1 Jun. 14, 2007

(51) Int. Cl.
*H05B 6/70* (2006.01)
*H05B 6/78* (2006.01)

(52) U.S. Cl. ..... 219/695; 219/696; 219/700; 219/746; 219/762; 34/259

(58) Field of Classification Search ..... 219/690–701, 219/746, 762, 756–757; 34/259–265
See application file for complete search history.

(56) References Cited

U.S. PATENT DOCUMENTS

| | | | | |
|---|---|---|---|---|
| 3,474,209 A | | 10/1969 | Parker | 219/10.55 |
| 3,555,232 A | | 1/1971 | Bleackley | 219/10.55 |
| 3,564,458 A | | 2/1971 | Cumming | 333/21 |
| 3,715,551 A | | 2/1973 | Peterson | |
| 3,749,874 A | * | 7/1973 | Edgar | 219/699 |
| 3,784,777 A | | 1/1974 | Soulier | 219/10.55 |
| 3,851,132 A | | 11/1974 | VanKoughnett | 219/10.55 A |
| 4,361,744 A | * | 11/1982 | Mercier et al. | 219/754 |
| 4,401,873 A | | 8/1983 | Berggren et al. | 219/10.55 A |
| 4,476,363 A | | 10/1984 | Berggren et al. | 219/10.55 A |
| 5,442,160 A | | 8/1995 | Kimrey, Jr. et al. | 219/690 |

(Continued)

FOREIGN PATENT DOCUMENTS

JP 1-274381 * 11/1989 ..... 219/693

OTHER PUBLICATIONS

Metaxas, A.C., and Meredith, R.J., "Industrial Microwave Heating," (Peter Peregrinus Ltd. on behalf of the IEEE, London, 1993), first published 1983, pp. 114-119.

*Primary Examiner*—Philip H Leung
(74) *Attorney, Agent, or Firm*—James T. Cronvich

(57) ABSTRACT

Heating and drying devices including generally rectangular waveguide applicators forming exposure chambers for uniformly heating materials. Material to be heated enters and exits a microwave exposure region of the chamber through entrance and exit ports at opposite ends of the chamber. Various techniques are used to achieve uniform or preferred heating effects. Exemplary techniques include: 1) passageways jutting outward of chamber side walls to accommodate and support the side edges of a conveyor belt to position the conveyed material close to the side walls; 2) ridges formed along top and bottom walls of the chamber to enhance edge heating; 3) metallic blocks extending along the length of the conveyor near the edges of the belt to enhance edge heating; 4) corner blocks to enhance heating of material in the middle of the chamber; 5) dormers formed in the top or bottom waveguide walls to support higher order, multi-peaked waveguide modes; 6) tapered waveguide segments to focus electromagnetic energy; 7) virtual short plates and virtual waveguide walls to selectively focus energy on the material; and 8) multiple-stage heaters having more than one chamber for extended dwell time or complementary heating effects on conveyed material.

57 Claims, 9 Drawing Sheets

U.S. PATENT DOCUMENTS

| | | | | |
|---|---|---|---|---|
| 5,958,275 | A | 9/1999 | Joines et al. | 219/693 |
| 6,020,579 | A | 2/2000 | Lewis et al. | 219/696 |
| 6,075,232 | A | 6/2000 | Joines et al. | 219/695 |
| 6,153,868 | A | 11/2000 | Marzat | |
| 6,246,037 | B1 | 6/2001 | Drozd et al. | 219/693 |
| 6,259,077 | B1 | 7/2001 | Drozd et al. | 219/693 |
| 6,384,392 | B1 * | 5/2002 | Lee et al. | 219/756 |
| 6,396,034 | B2 | 5/2002 | Drozd et al. | 219/693 |
| 6,590,191 | B2 | 7/2003 | Drozd et al. | 219/695 |
| 6,753,516 | B1 | 6/2004 | Butler et al. | 219/745 |
| 6,797,929 | B2 | 9/2004 | Drozd et al. | 219/696 |
| 6,833,537 | B2 | 12/2004 | Risman et al. | 219/690 |
| 6,872,927 | B2 | 3/2005 | Geisler et al. | 219/700 |
| 6,888,115 | B2 | 5/2005 | Drozd | 219/701 |

* cited by examiner

WAVEGUIDE EXPOSURE CHAMBER FOR HEATING AND DRYING MATERIAL

BACKGROUND

The invention relates generally to microwave heating and drying devices and, more particularly, to waveguide applicators forming exposure chambers through which materials are conveyed and subjected to uniform microwave heating.

In many continuous-flow microwave ovens, a planar product or a bed of material passes through a waveguide applicator in or opposite to the direction of wave propagation. These ovens are typically operated in the $TE_{10}$ mode to provide a peak in the heating profile across the width of the waveguide applicator midway between its top and bottom walls at product level. This makes it simpler to achieve relatively uniform heating of the product. But $TE_{10}$-mode applicators are limited in width. Accommodating wide product loads requires a side-by-side arrangement of individual slotted $TE_{10}$ applicators or a single wide applicator. The side-by-side arrangement is harder to build and service than a single wide applicator, but wide applicators support high order modes, which can be difficult to control. The result is non-uniform heating across the width of the product.

Thus, there is a need for a continuous-flow microwave oven capable of uniformly heating wide product loads.

SUMMARY

This need and other needs are satisfied by a microwave heating device embodying features of the invention. In one aspect of the invention, the heating device comprises a waveguide that extends in height from a top wall to a bottom wall and in width from a first side wall to a second side wall. The waveguide defines along a portion of its length an exposure chamber having a generally rectangular cross section. A microwave source supplies electromagnetic energy to the exposure chamber in the form of electromagnetic waves propagating along the length of the waveguide through the exposure chamber in a direction of wave propagation. The exposure chamber extends in the direction of wave propagation from a first end to a second end. A first port opens through the waveguide at the first end into the exposure chamber, and a second port opens through the waveguide at the second end into the exposure chamber. A conveyor that extends in width from a first edge to a second edge passes through the exposure chamber along a conveying path in the direction of wave propagation via the first and second ports. The conveyor carries material to be heated by electromagnetic energy in the exposure chamber. The first side wall forms a first passageway extending from the first port to the second port between the top and bottom walls, and the second side wall forms a second passageway extending from the first port to the second port opposite the first passageway across the width of the exposure chamber to accommodate the first and second edges of the conveyor.

According to another aspect of the invention, a microwave heating device comprises a waveguide defining along a portion of its length an exposure chamber. A microwave source supplies electromagnetic energy to the exposure chamber in the form of electromagnetic waves of wavelength $\lambda$ propagating along the length of the waveguide through the exposure chamber in a direction of wave propagation. The waveguide includes a top wall, a bottom wall, and first and second side walls forming in the exposure chamber a generally rectangular cross section. The width of the cross section is measured between the side walls, and the height is less than $\lambda$ between the top and bottom walls. The exposure chamber extends in the direction of wave propagation from a first end to a second end. A first port through which material to be heated enters the exposure chamber is formed in the waveguide at the first end. A microwave exposure region in which the material to be heated is exposed to the electromagnetic energy extends in length between the first port and the second end and in width from the first side wall to the second side wall. The first and second side walls have top portions connecting to the top wall and bottom portions connecting to the bottom wall. The distance between the top portions of the first and second side walls differs from the distance between the bottom portions.

According to yet another aspect of the invention, a microwave heating device comprises a waveguide defining along a portion of its length an exposure chamber. A microwave source supplies electromagnetic energy to the exposure chamber in the form of electromagnetic waves of wavelength $\lambda$ propagating along the length of the waveguide through the exposure chamber in a direction of wave propagation. The waveguide includes a top wall, a bottom wall, and first and second side walls forming in the exposure chamber a generally rectangular cross section. The width of the cross section is greater than or equal to $\lambda/2$ between the side walls, and the height is less than $\lambda$ between the top and bottom walls. The exposure chamber extends in the direction of wave propagation from a first end to a second end. A first port into the exposure chamber is formed through the waveguide at the first end; a second port is formed through the waveguide at the second end. The first and second ports define a microwave exposure region between them in which material to be heated is exposed to the electromagnetic energy. The exposure region extends in width from the first side wall to the second side wall. A first ridge extends along at least a portion of the length of the exposure chamber from the first side wall proximate the microwave exposure region. An opposite second ridge extends from the second side wall to enhance the heating of the material near the first and second side walls.

According to another aspect of the invention, a microwave heating device comprises a first waveguide and a second waveguide. The first waveguide defines along a portion of its length a first exposure chamber having a generally rectangular cross section dimensioned to support $TE_{2m}$ electromagnetic waves. The second waveguide defines along a portion of its length a second exposure chamber having a generally rectangular cross section dimensioned to support $TE_{1n}$ electromagnetic waves. At least one microwave source supplies electromagnetic energy to the first and second exposure chambers in the form of electromagnetic waves propagating along the lengths of the waveguides through the exposure chambers in a direction of wave propagation in each. The exposure chambers extend in the direction of wave propagation between first ends and second ends. First ports are formed through the waveguides at the first ends into the exposure chambers and second ports at the second ends to define a microwave exposure region in each of the exposure chambers between the first and second ports in which material to be heated is exposed to the electromagnetic waves.

According to another aspect of the invention, a microwave heating device comprises a waveguide that defines along a portion of its length an exposure chamber having a generally rectangular cross section defined by top and bottom walls and first and second side walls. A microwave source supplies electromagnetic energy to the exposure chamber in the form of electromagnetic waves propagating along the length of the waveguide through the exposure chamber in a direction of wave propagation. The electromagnetic waves have electric field lines that extend across the exposure chamber from the first side wall to the second side wall. The exposure chamber extends in the direction of wave propagation from a first end to a second end. A first port is formed through the waveguide at the first end into the exposure chamber. A second port is formed through the waveguide at the second end. A conveyor conveys material through the exposure chamber generally along the direction of wave propagation via the first and second ports. The conveyor extends in width from a first edge proximate the first side wall of the exposure chamber to a second edge proximate the second side wall of the exposure chamber. A first ridge extends along the length of the exposure chamber from the first side wall proximate the first edge of the conveyor, and an opposite second ridge extends from the second side wall to enhance the heating of the material near the first and second side walls.

According to still another aspect of the invention, a microwave heating device comprises a waveguide defining along a portion of its length an exposure chamber supplied electromagnetic energy by a microwave source. The electromagnetic energy is in the form of electromagnetic waves of wavelength $\lambda$ propagating along the length of the waveguide through the exposure chamber in a direction of wave propagation. The waveguide includes a top wall, a bottom wall, and first and second side walls that form a generally rectangular cross section having a width less than $\lambda/2$ between the side walls and a height less than $\lambda$ between the top and bottom walls. The exposure chamber extends in the direction of wave propagation from a first end to a second end. A first port is formed through the waveguide at the first end into the exposure chamber, and a second port is formed at the second end to define a microwave exposure region between the first and second ports from the first side wall to the second side wall in which material to be heated is exposed to the electromagnetic energy. A first ridge extends along at least a portion of the length of the exposure chamber from the first side wall proximate the microwave exposure region, and an opposite second ridge extends from the second side wall to enhance the heating of the material near the first and second side walls.

BRIEF DESCRIPTION OF THE DRAWINGS

These features and aspects of the invention, as well as its advantages, are better understood by reference to the following description, appended claims, and accompanying drawings, in which:

DETAILED DESCRIPTION

Figure 1:
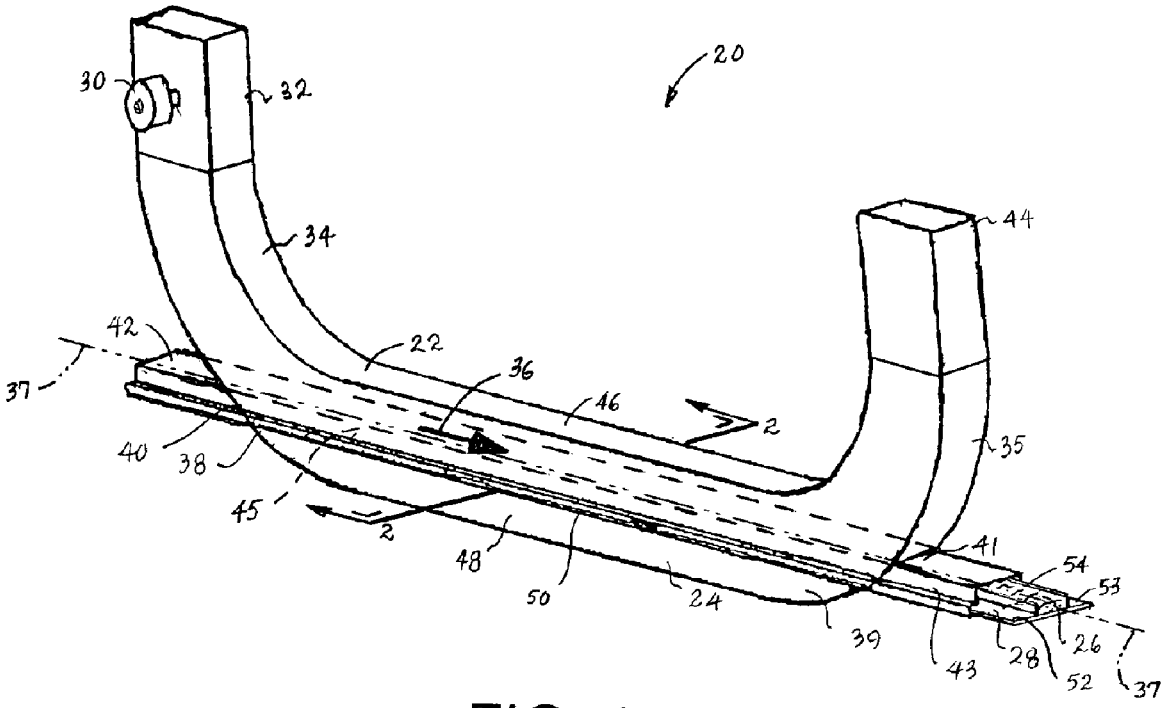
FIG. 1 is an isometric view of one version of a microwave heating device embodying features of the invention, including a waveguide exposure chamber with lateral recesses.
Figure 2:
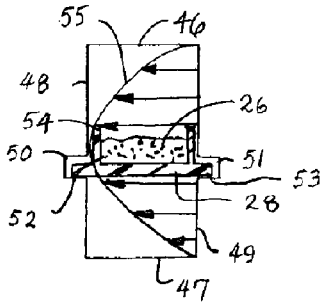
FIG. 2 is a cross section of the exposure chamber of FIG. 1 taken along lines 2-2.

One version of a microwave heating device embodying features of the invention is shown in FIGS. 1 and 2. The heating device 20 includes a U-shaped section of waveguide 22 that is generally rectangular in cross section. ("Rectangular waveguide" is used in a broad sense to encompass waveguides that may not be perfect four-sided geometric rectangles, but that have a number of corners in cross section as opposed to circular or elliptical waveguides whose cross sections do not have corners.) A portion of the waveguide forms an exposure chamber 24 through which a material 26 to be heated is conveyed on a conveyor, such as a belt conveyor 28. A microwave source 30, such as a magnetron, supplies microwave energy to the exposure chamber through a launcher 32 and a first waveguide bend segment 34. Microwave energy propagates through the exposure chamber in a direction of propagation 36 from a first end 38 to an opposite second end 39. The conveyor advances along a conveying path into and out of the chamber in or opposite to the direction of propagation through entrance and exit ports 40, 41 formed in the curved waveguide walls marking the ends of the exposure chamber. The conveyor carries the material to be heated through a microwave exposure region 45 in the chamber between the two ports. The microwave exposure region is generally the volume the material occupies within the exposure chamber; the exposure region's orientation is defined by an axis 37 through the first and second ports. Entrance and exit tunnels 42, 43 over the conveyor lead from the waveguide at the ports to chokes (not shown) to prevent radiation from leaking through the open ports. A second waveguide bend segment 35 guides microwave energy from the chamber to a matched-impedance load 44 to minimize reflections and standing waves in the chamber.

As shown in FIG. 2, the cross section of the waveguide in the chamber is generally rectangular. The waveguide extends in height from a top wall 46 to a bottom wall 47 and in width between opposite side walls 48, 49. Outwardly jutting passageways 50, 51 formed in the side walls extend the length of the exposure chamber from the first port to the second port. The passageways, which are shown closed on three sides in this example, admit opposite side edges 52, 53 of the conveyor belt 28. In this way, conveyed material can extend across the width of the belt close to the side walls of the chamber. Side guards 54 on the belt prevent conveyed material from falling over the side edges. The ports and the passageways preferably reside at a level to position the material to be heated in the exposure region about midway between the top and bottom walls. The chamber may alternatively be used without a conveyor to heat materials, such as plywood sheets, whose edges can be supported in the passageways without the need for a conveyor traveling through the exposure region. The chamber may alternatively have only a single port through which the material to be heated enters and exits the exposure region. Positioning the material at or near the peak of a $TE_{10}$-mode electromagnetic wave 55 having electric field lines directed from side wall to side wall across the chamber maximizes heating.

Figure 3:
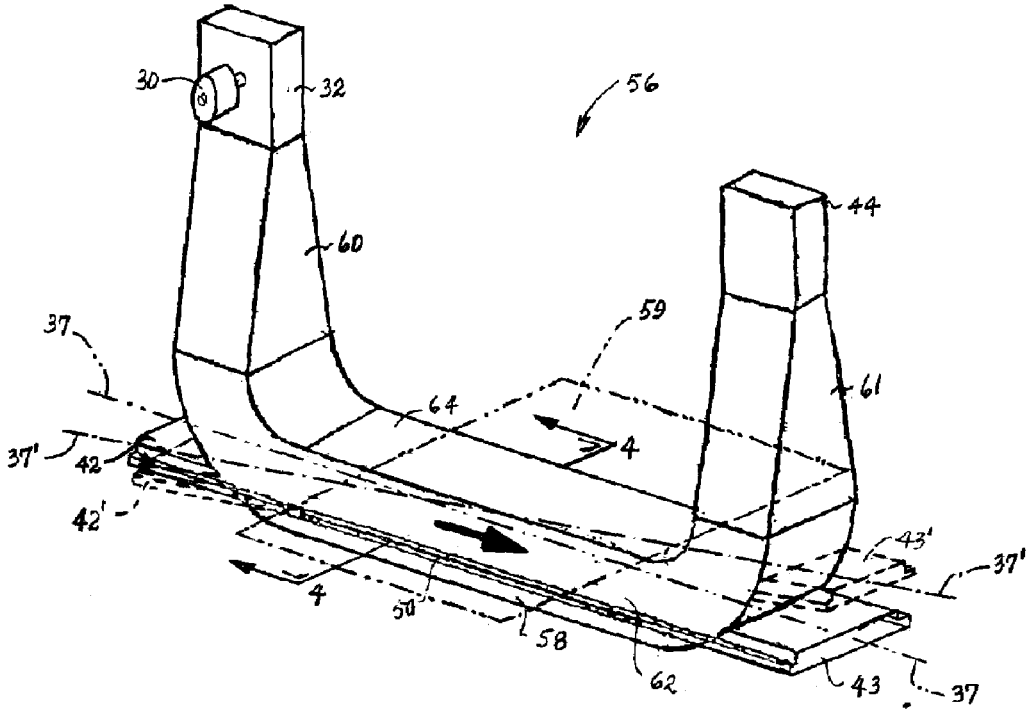
FIG. 3 is an isometric view of another version of a microwave heating device embodying features of the invention, including a wide waveguide exposure chamber with lateral passageways.
Figure 4A:
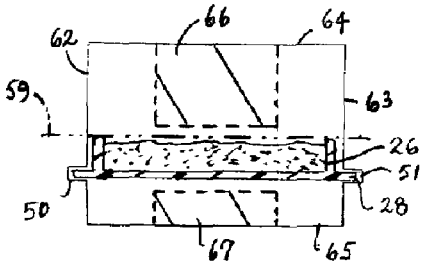
FIGS. 4A and 4B are cross sections of the chamber of FIG. 3 taken along lines 4-4 with alternative optional block arrangements.
Figure 4B:
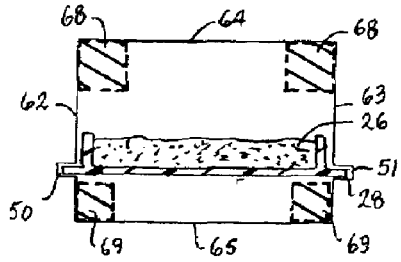

Another version of a heating device is shown in FIG. 3. The heating device 56 has a wide heating chamber 58 to accommodate wider material loads for greater throughput than the heating device of FIG. 1 provides. Tapered waveguide segments 60, 61 connect the exposure chamber to the microwave launcher 32 and the terminating load 44. As shown in FIGS. 4A and 4B, the generally rectangular cross section of the waveguide is dimensioned to support $TE_{1n}$ electromagnetic waves including those with modes above $TE_{10}$. Thus, the width of the waveguide between opposite side walls 62, 63 is preferably greater than or equal to half the wavelength ($\lambda$) of the electromagnetic wave supplied by the microwave source 30. The height of the exposure chamber between opposite top and bottom walls 64, 65 is preferably less than the wavelength of the electromagnetic wave to support multiple-mode $TE_{1n}$ waves. Like the exposure chamber of FIG. 1, the wide exposure chamber is shown with side passageways 50, 51 to accommodate the side edges of the conveyor belt 28. In this example, the conveyor enters and exits the chamber through tunnels 42, 43 at a level offset vertically from an imaginary plane 59 midway between the top and bottom walls. The offset is used to position the conveyed material at a preferred position in the electromagnetic field. Although the conveying path, or the microwave exposure region as defined by its axis 37, is shown parallel to and offset from the imaginary midplane of the chamber in FIG. 3, the path, or the microwave exposure region as defined by an angled axis 37', could alternatively be arranged oblique to the plane, as indicated in broken lines by angularly disposed tunnels 42' and 43', to help achieve a desired heating effect.

FIGS. 4A and 4B depict alternative schemes for achieving different heating effects in the exposure chamber. In FIG. 4A, top and bottom metallic ridges 66, 67 attached diametrically opposite each other to the top and bottom walls midway between the side walls tend to deflect heating electromagnetic energy toward the side walls to enhance edge heating. The ridges also tend to suppress higher order modes from forming in the chamber. The ridges may be continuous along the entire length of the chamber or along only a portion of the length. Furthermore, the ridges may be segmented or vary in cross section, including shape, along the length of the chamber depending on the dielectric properties of the materials to be heated and the desired heating effects. One or more bottom ridges may be used to support rigid materials, such as wood sheets, in the microwave exposure region without the need for a conveyor.

Metallic corner blocks 68, 69 attached to the corners of the waveguide forming the exposure chamber enhance the heating of the material conveyed in the middle of the conveyor belt, as shown in FIG. 4B. The blocks direct the heating energy away from the side walls and toward the middle of the chamber. Like the ridges in FIG. 4A, the corner blocks may extend partway or all the way along the length of the chamber, may vary in cross section, or may be segmented. And, for different heating effects, the corner blocks or the ridges may be made of dielectric materials. The corner blocks or the ridges may alternatively be realized by jutting the top, bottom, and side walls of the waveguide inward to form equivalent blocks and ridges. Of course, individual corner blocks and ridges may be combined or left out entirely.

Figure 5:
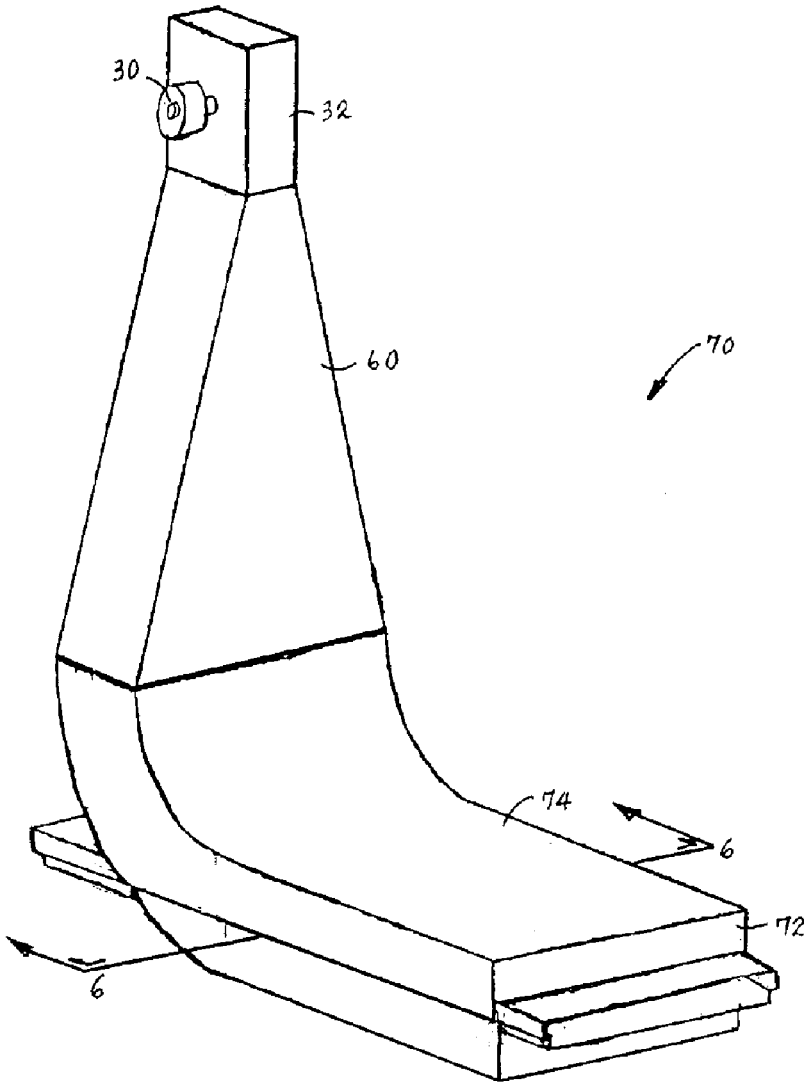
FIG. 5 is an isometric view of yet another version of a microwave heating device embodying features of the invention, including a slightly narrowed lower chamber region.
Figure 6:
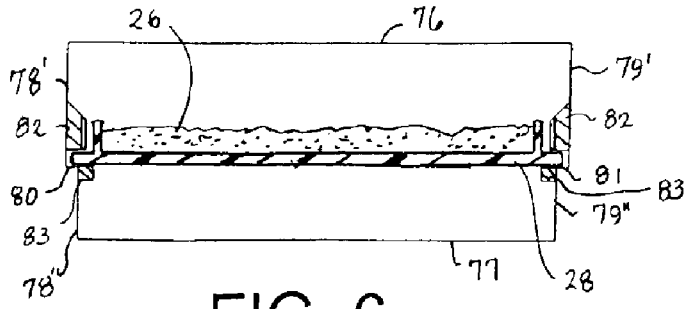
FIG. 6 is a cross section of the chamber of FIG. 5 taken along lines 6-6, showing side blocks for improved edge heating.

FIGS. 5 and 6 show a variation of the heating device of FIG. 3. The heating device 70 terminates in a shorting plate 72 at an end of the microwave exposure chamber 74. Using a shorting plate instead of a matched-impedance load permits a shorter chamber than that in FIG. 3 to be used, but causes standing waves to form. As shown in FIG. 6, the cross section of the wide exposure chamber is generally rectangular, extending in height from a top wall 76 to a bottom wall 77 and in width between opposite side walls having top portions 78', 79' and bottom portions 78", 79". The side walls jog inward along wall segments just below mid-height to form ledges 80, 81 that support the side edges of the conveyor belt 28. Thus, the distance between the top portions of the side walls is greater than the distance between the bottom portions of the side walls. Two pairs of blocks 82, 83 attached to the side walls just above and below the level of the conveyor enhance the heating of the side edges of the conveyed material 26. The lower blocks 83 also serve to add further support to the side edges of the conveyor belt. The upper blocks 82 are shown with a step change in cross section. Of course, the exact shapes and sizes of the blocks may be tailored to the application. But the blocks extend inward of the side walls only a small fraction of the distance across the width of the waveguide. The inward jog of the side walls directs the heating energy away from the side walls and toward the middle of the chamber. As in the other embodiments, some materials, such as those in the form of rigid sheets, may be introduced into the exposure region of the chamber through the ports and supported on the lower blocks or the ledges. In these cases, a conveyor extending through the chamber is not needed.

Figure 7:
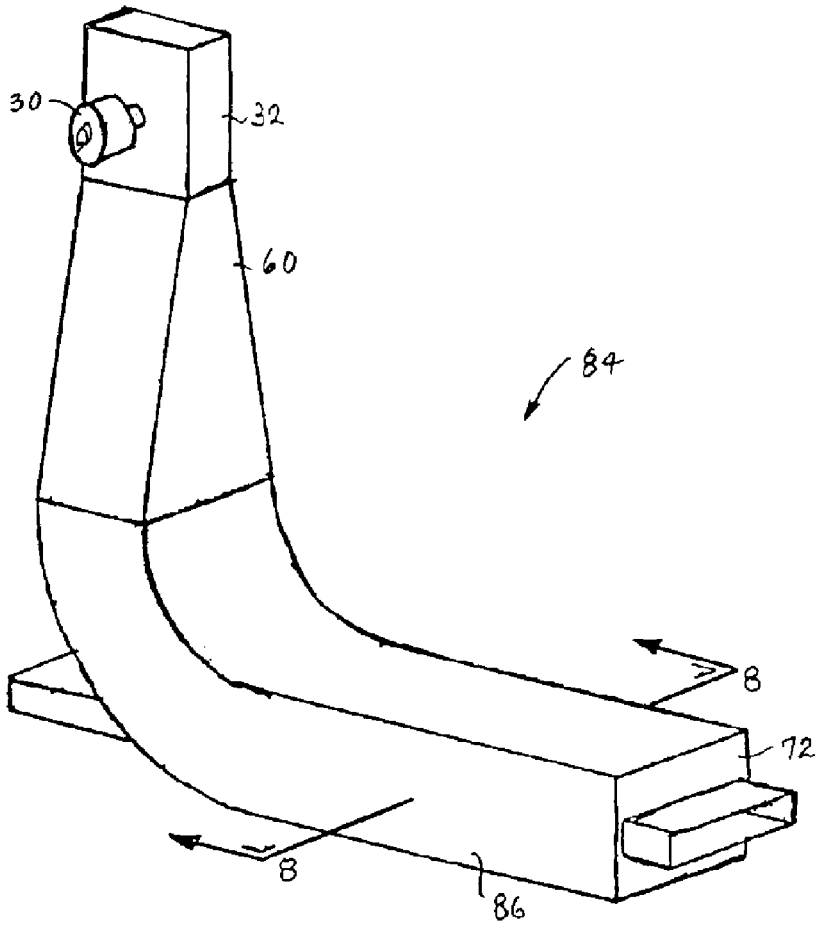
FIG. 7 is an isometric view of another version of a microwave heating device embodying features of the invention, including a waveguide exposure chamber with a rectangular cross section.
Figure 8:
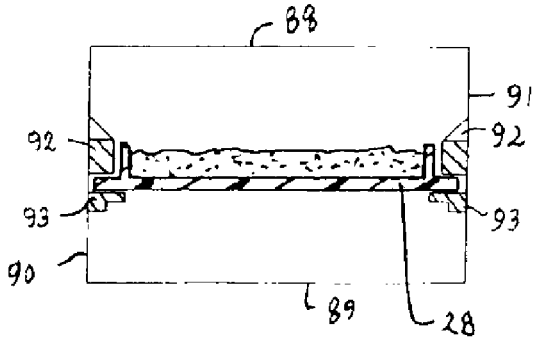
FIG. 8 is a cross section of the exposure chamber of FIG. 7 taken along lines 8-8 to show side blocks used for better edge heating.

Another version of heating device is shown in FIGS. 7 and 8. Like the device shown in FIG. 5, this heating device 84 has an exposure chamber 86 that terminates in a shorting plate 72. The cross section in this version is perfectly rectangular, extending between opposite top and bottom walls 88, 89 and side walls 90, 91. Upper and lower blocks 92, 93, attached to the side walls, extend slightly inward into the chamber. The lower blocks 93 support the edges of the conveyor 28. Like the blocks in FIG. 6, these blocks direct heating energy away from the side walls and into the outer side edges of the conveyed material.

Figure 9:
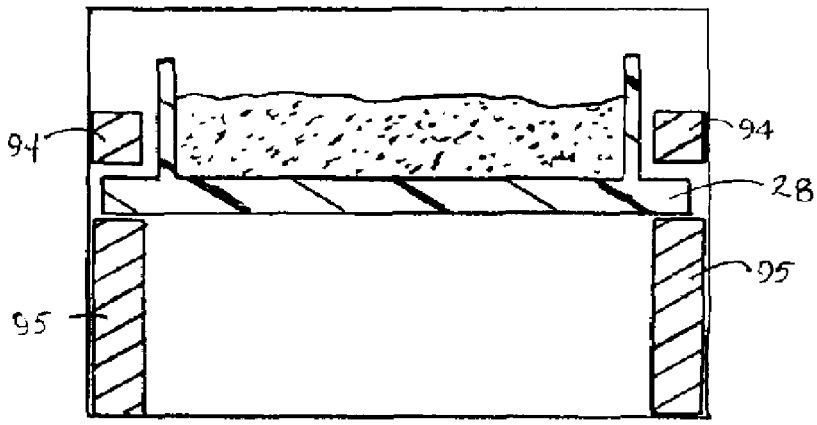
FIG. 9 is a cross sectional view of another alternative microwave heating device as in FIG. 8 with a slightly different block arrangement in the exposure chamber.
Figure 10:
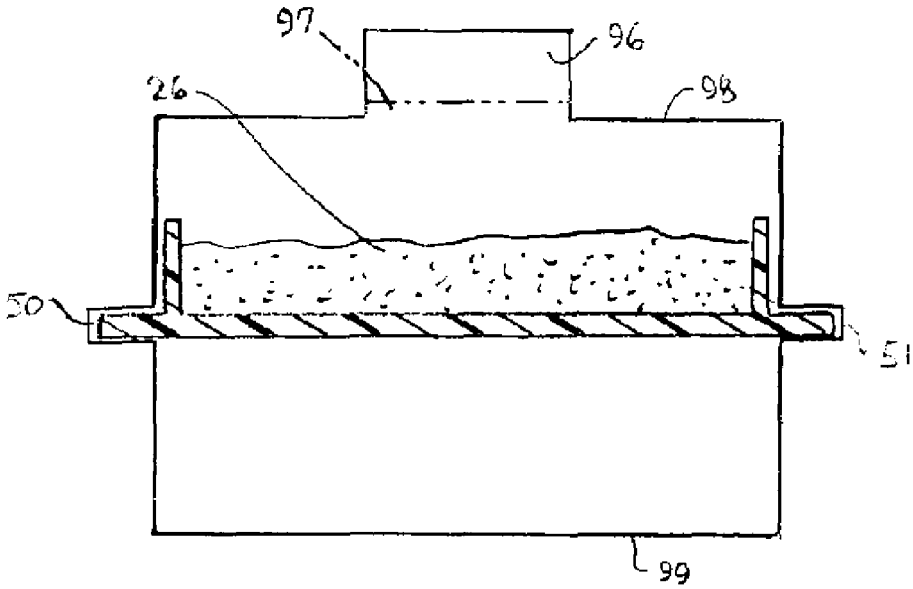
FIG. 10 is a cross sectional view of an alternative microwave heating device embodying features of the invention, including a dormer extending along the length of the exposure chamber for improved mid-product heating.

Other heating chamber configurations are shown in FIGS. 9 and 10. In FIG. 9, the microwave exposure chamber is rectangular with upper blocks 94 attached to the side walls and lower blocks 95 extending upward from the bottom corners to a supporting position for the side edges of the conveyor belt 28. The lower blocks affect heating in a similar manner as the narrower bottom chamber portion formed by the side-wall jog in the chamber of FIG. 6. In FIG. 10, a dormer tunnel 96 is formed as a recess extending along at least a portion of the length of the top wall 98 of the exposure chamber. (The dormer could alternatively or additionally be formed in the bottom wall 99.) Like the side-wall passageways 50, 51, the dormer recess extends the walls of the waveguide outward of a perfect rectangle. But the waveguide still maintains its generally rectangular cross section. The dormer enhances the heating of the middle of the conveyed material 26 by supporting higher order modes that peak more toward the middle of the waveguide applicator. The dormer's cross sectional area or shape may be constant or variable along all or part of the length of the chamber. For example, the dormer could optionally taper to a shallower remote end 97.

Figure 11:
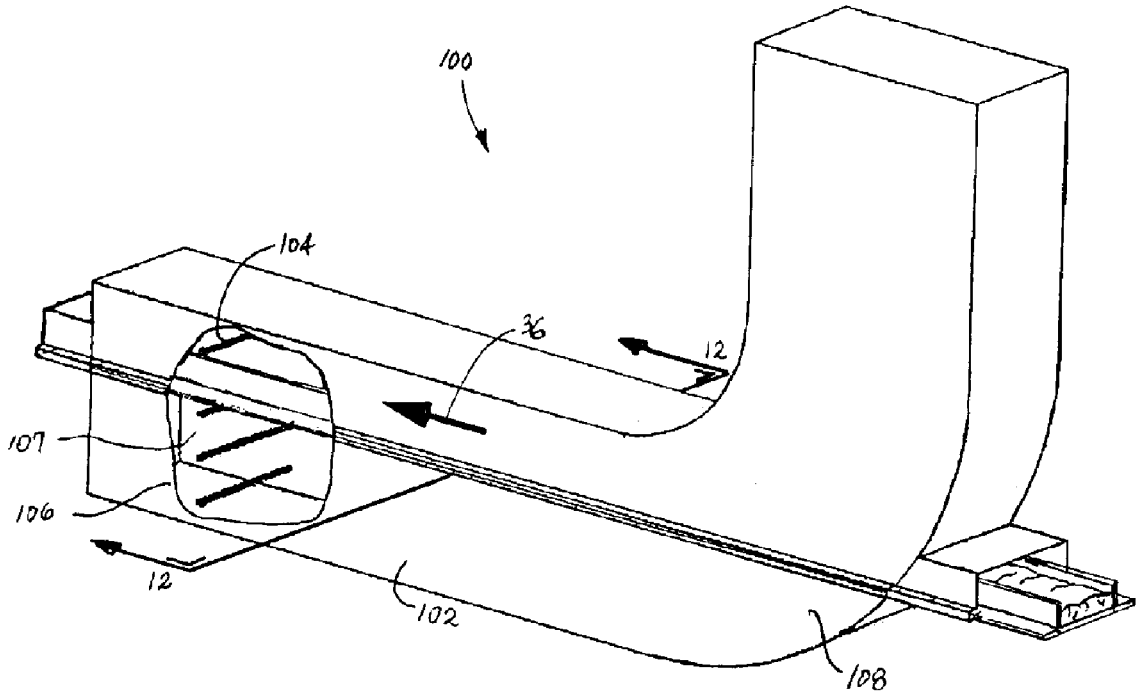
FIG. 11 is an isometric view, partly cut away, of a microwave heating device embodying features of the invention, including virtual short plate bars to help control the microwave energy distribution within a material to be heated and to tune the waveguide exposure chamber.
Figure 12:
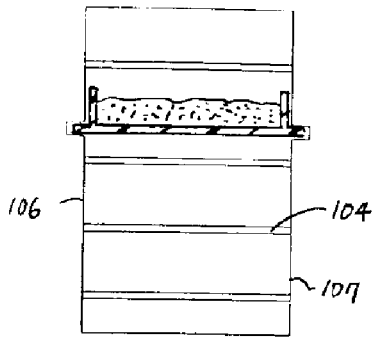
FIG. 12 is a cross section of the chamber of FIG. 11 taken along lines 12-12.

The heating device 100 shown in FIGS. 11 and 12 has a standing-wave exposure chamber 102 like those in FIGS. 5 and 7, but narrow enough, e.g., with a width less than half a wavelength, to support $TE_{10}$ as the dominant mode. Bars 104 attached at opposite ends to side walls 106, 107 of the chamber are arranged in a vertical row traversing the direction of wave propagation 36. The bars form a virtual short-circuit plate, which may be positioned along the length of the chamber to adjust the location of the peak of the standing wave in the bend portion 108 of the chamber to a desired focal level in the conveyed material, i.e., in the vertical direction in FIG. 11. If the bend into the chamber were horizontal instead of vertical, the virtual shorting bars could be used to heat one side of the material more than the other. Thus, the virtual shorting bars, which adjust the standing wave pattern in the exposure chamber, can be used to fine-tune the heating pattern in the bend portion of the exposure chamber.

Figure 13:
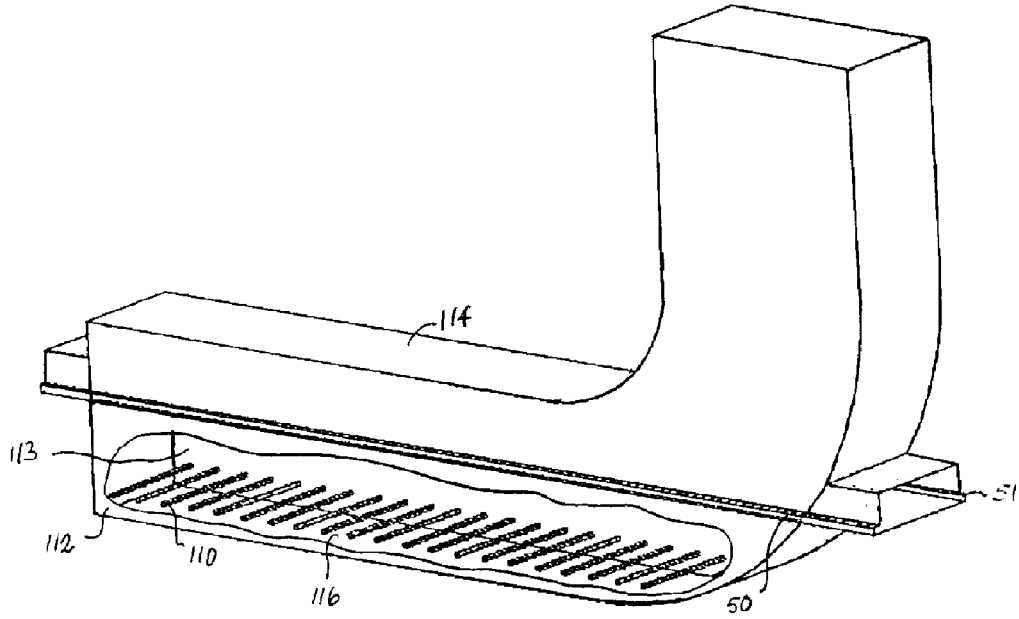
FIG. 13 is an isometric view, partly cut away, of a microwave heating device embodying features of the invention, including side wall passageways and virtual waveguide walls formed by spaced bars in the exposed chamber.
Figure 14:
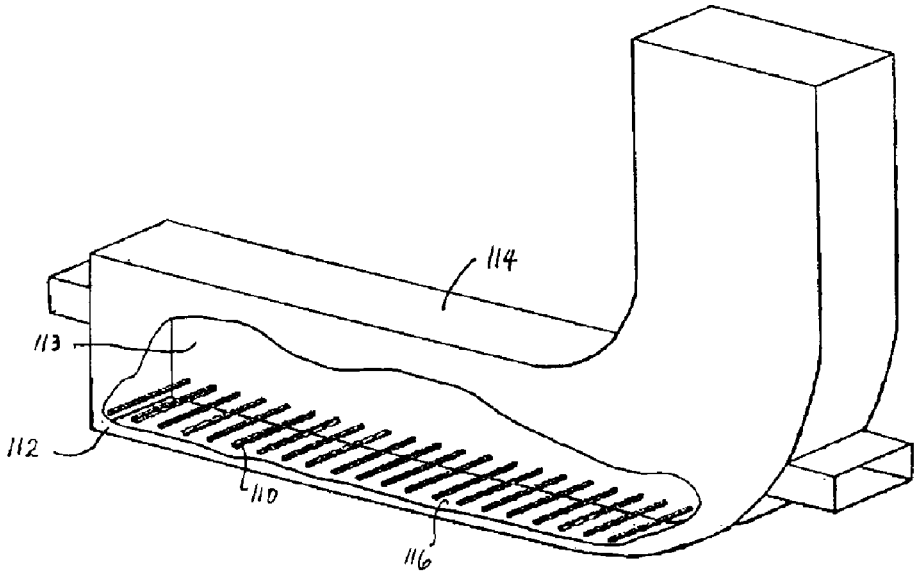
FIG. 14 is an isometric view as in FIG. 13 of a microwave heating device without side wall passageways.

FIGS. 13 and 14 show two versions of a narrow $TE_{10}$ heating chamber, as in FIG. 11, that can be adjusted to focus the heating energy at selected heights through the conveyed material. The only difference between the heating devices in FIGS. 13 and 14 is that the device in FIG. 13 has side-wall passageways 50, 51 to accommodate the side edges of a conveyor belt and the device in FIG. 14 does not. Both chambers feature a row of closely spaced bars 110 attached at opposite ends to opposite side walls 112, 113 of an exposure chamber 114. Bar-to-bar spacing is less than half the wavelength of the electromagnetic wave. The row of bars creates a virtual bottom wall of the chamber. Thus, changing the position of the row of bars away from the chamber's actual bottom wall 116 adjusts the peak of the heating energy through the thickness of the bed of material conveyed through the chamber. The row may be aligned parallel to the bottom or slightly oblique to it as required to better fit the application.

Figure 15:
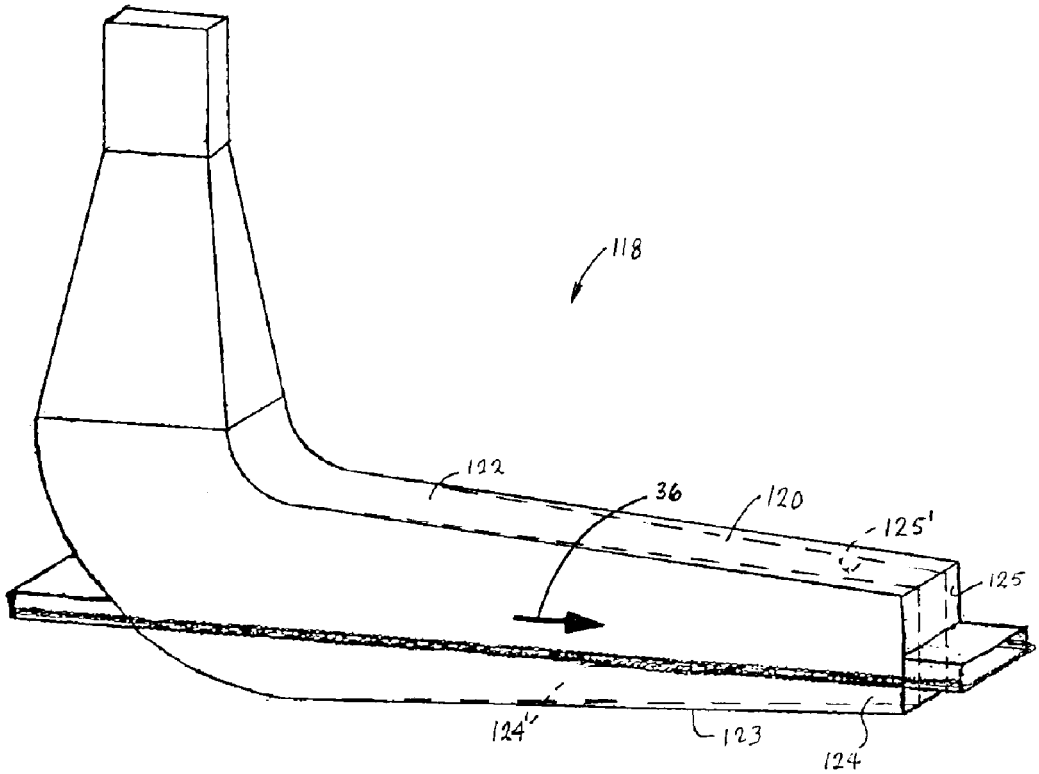
FIG. 15 is an isometric view of another version of a microwave heating device embodying features of the invention, including a tapered waveguide exposure region.

The heating device 118 of FIG. 15 can also be used to adjust the focus of the heating energy in a conveyed material. This heating device includes a tapered heating chamber 120 whose top and bottom walls 122, 123 converge between parallel side walls 124, 125 narrowing with distance from the microwave source. Thus, the cross-sectional area of the chamber decreases in the direction of wave propagation 36. The angle of convergence and the position of the conveyor relative to the top and bottom walls are used to adjust the heating intensity along the conveying path through the chamber. Alternatively, the chamber can be tapered in width, with side walls 124', 125' converging along the direction of propagation, to change the focus of the heating energy across the width of the material to be heated. (Two walls "converge" when their separation decreases along the direction of propagation regardless of whether only one or both walls are oblique to the direction of propagation.)

Figure 16:
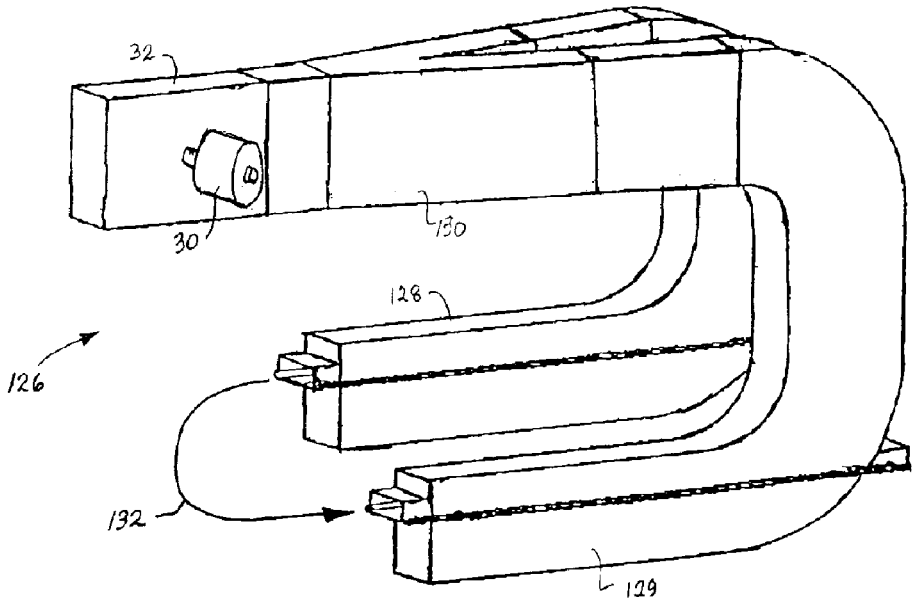
FIG. 16 is an isometric view of parallel microwave exposure chambers embodying features of the invention and fed from a single microwave source.

Yet another version of a microwave heating device is shown in FIG. 16. The device 126 is a two-stage heating device with two separate heating chambers 128, 129. In this example, each chamber is energized from a common microwave source 30 and launcher 32. A power-splitting waveguide section 130 divides the electromagnetic energy into separate waveguide paths that lead to the two exposure chambers. Material heated in the first chamber 128 can be conveyed into the second chamber 129, as indicated by arrow 132. The heat treatment in both chambers may be identical or complementary. Thus, the two-stage, cascaded heaters through which material is conveyed sequentially can be used to increase dwell time or to achieve uniform heating throughout the material.

Figure 17:
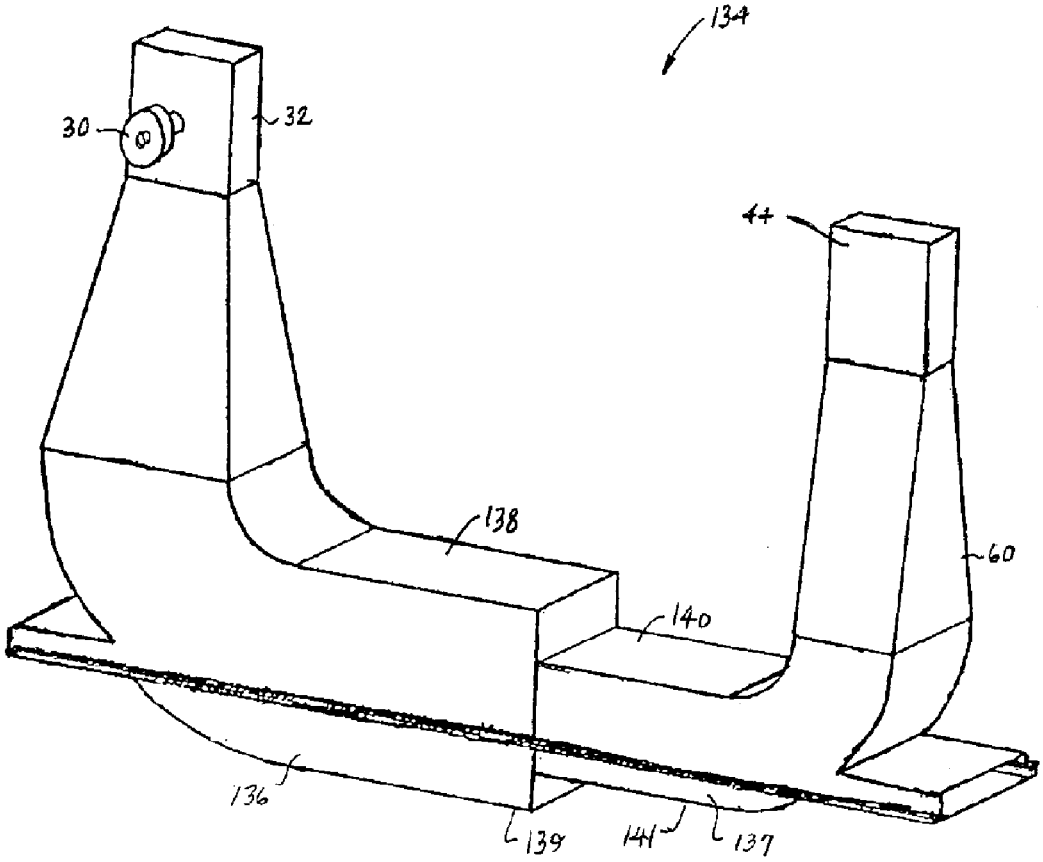
FIG. 17 is an isometric view of another version of a microwave heating device embodying features of the invention, including a two-stage, cascaded waveguide exposure region.

Another version of two-stage heater is shown in FIG. 17. This mixed-mode heater 134 has two heating chambers 136, 137 of different dimensions connected in series. The height of the first heating chamber exceeds that of the second heating chamber to enable the first chamber to support higher order modes. For example, if the height of the first chamber equals or exceeds the wavelength of the electromagnetic wave supplied by the source 30, the first chamber can support $TE_{20}$ and higher modes. With two $TE_{2m}$ microwave energy peaks between top and bottom walls 138, 139 of the first chamber, the material is heated at both the top and bottom of the material bed. Because the vertical dimension of the second chamber between top and bottom surfaces 140, 141 is less than the wavelength of the electromagnetic wave, $TE_{1n}$ modes, which produce a central energy peak, are supported. The top and bottom heating of the material in the first chamber is followed by the central heating of the material in the abutting second chamber to achieve uniform heating of the material exposed sequentially in or conveyed through the cascaded chambers, each of which supports a different TE mode.

Figure 18:
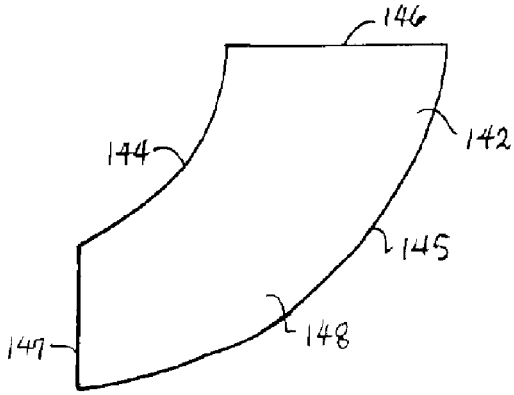
FIG. 18 is a side view of a tapered bend segment for a microwave heating device as in FIG. 1.

Reflections in the waveguides that can travel back to the microwave source can be mitigated by the tapered bend segment 142 shown in FIG. 18. The bend segment may be used in any of the heating devices shown. The bend segment has inner and outer curved walls 144, 145 that converge toward each other from an input end 146 nearer the microwave source to an opposite output end 147. Side walls 148 between the curved walls complete the bend segment structure. The distance across each side wall decreases toward the output end. The area of the opening into the tapered bend segment is greater at the input end than at the output end. Because it is easier to control the energy pattern in the tapered bend segment, the tapered segment is useful as the entrance portion of a microwave exposure chamber at which the material to be heated is introduced.

Although the invention has been disclosed in detail with reference to a few preferred versions, other versions are possible. The side wall passageways, blocks, corner blocks, dormers, and ridges may be used with each other in various combinations, symmetrical or asymmetrical, to achieve a desired heating pattern. They may reside in the bend segments of the waveguide as well as in the straight segments as depicted in the drawings. The heating chambers may be terminated in short circuits to produce standing wave patterns or in matched impedances to avoid standing waves and hot spots along the length of the heating chamber. Although the preferred frequency of operation is one of the standard commercial frequencies (915 MHz or 2450 MHz), the waveguide structures may be dimensioned to work at other frequencies.

Furthermore, they may be used with a variable-frequency microwave generator. So, as these few examples suggest, the scope of the claims is not meant to be limited to the details of the versions described.

What is claimed is:

1. A microwave heating device comprising:

a waveguide extending in height from a top wall to a bottom wall and in width from a first side wall to a second side wall to define along a portion of its length an exposure chamber having a generally rectangular cross section;

a microwave source supplying electromagnetic energy to the exposure chamber in the form of electromagnetic waves propagating along the length of the waveguide through the exposure chamber in a direction of wave propagation;

wherein the exposure chamber extends in the direction of wave propagation from a first end to a second end and forms a first port through the waveguide at the first end into the exposure chamber and a second port through the waveguide at the second end into the exposure chamber;

a conveyor extending in width from a first edge to a second edge and passing through the exposure chamber along a conveying path in the direction of wave propagation via the first and second ports and carrying material to be heated by electromagnetic energy in the exposure chamber;

wherein the first side wall forms a first enclosed passageway extending from the first port to the second port between the top and bottom walls and wherein the second side wall forms a second enclosed passageway extending from the first port to the second port opposite the first passageway across the width of the exposure chamber to accommodate the first and second edges of the conveyor.

2. A microwave heating device as in claim 1 wherein the rectangular cross section of the exposure chamber is dimensioned to support multiple-mode $TE_{1n}$ electromagnetic waves, including the $TE_{1N}$ mode, where $0 \leqq n \leqq N$ and $N>0$.

3. A microwave heating device as in claim 1 wherein the rectangular cross section of the exposure chamber is dimensioned to support $TE_{1n}$ electromagnetic waves, where $n>0$.

4. A microwave heating device as in claim 1 further comprising at least one of a top ridge extending at least partly along the length of the exposure chamber from the top wall and an opposite bottom ridge extending from the bottom wall intermediately disposed between the first and second side walls to enhance the heating of the material near the first and second side walls.

5. A microwave heating device as in claim 4 wherein the cross section of the at least one top and bottom ridges varies along the length of the exposure chamber.

6. A microwave heating device as in claim 1 further comprising one or more corner blocks extending at least partly along the length of the exposure chamber at one or more of the corners of the generally rectangular exposure chamber to enhance the heating of the material near the middle of the conveyor.

7. A microwave heating device as in claim 1 further comprising blocks extending at least partly along the length of the exposure chamber from the top and bottom walls or the first and second side walls at diametrically opposed positions to increase the overall uniformity of the heating of the material conveyed through the exposure chamber.

8. A microwave heating device as in claim 1 further comprising blocks extending along the length of the exposure chamber from the top, bottom, or side walls, and wherein the cross sections of the blocks vary along the length of the exposure chamber.

9. A microwave heating device as in claim 1 further comprising a recess formed in the top or bottom wall of the exposure chamber and extending along at least a portion of the length of the exposure chamber.

10. A microwave heating device as in claim 9 wherein the cross section of the recess varies along the length of the exposure chamber.

11. A microwave heating device as in claim 1 further comprising a plurality of bars spaced apart along the length of the exposure chamber and extending from the first side wall to the second side wall of the exposure chamber proximate the top or bottom wall and wherein the exposure chamber is dimensioned to support $TE_{10}$ electromagnetic waves.

12. A microwave heating device as in claim 1 further comprising a plurality of bars extending from the first side wall to the second side wall of the exposure chamber and arranged between the top and bottom walls in a row traversing the direction of wave propagation and wherein the exposure chamber is dimensioned to support $TE_{10}$ electromagnetic waves.

13. A microwave heating device as in claim 1 further comprising a tapered waveguide bend segment, rectangular in cross section, disposed between the microwave source and the exposure chamber, wherein the area of the cross section is greater nearer the microwave source.

14. A microwave heating device as in claim 1 wherein the area of the cross section of the exposure chamber decreases with distance from the microwave source.

15. A microwave heating device as in claim 1 wherein the top and bottom walls of the exposure chamber converge with distance from the microwave source.

16. A microwave heating device as in claim 1 wherein the first and second side walls of the exposure chamber converge as a function of distance from the microwave source.

17. A microwave heating device as in claim 1 wherein the conveying path is oblique to an imaginary plane midway between the top and bottom walls of the exposure chamber.

18. A microwave heating device as in claim 1 wherein the conveying path is offset from and parallel to an imaginary plane midway between the top and bottom walls of the exposure chamber.

19. A microwave heating device as in claim 1 further comprising:

a second waveguide having a second exposure chamber;

wherein the two waveguides are arranged so that the material to be heated is conveyed through both exposure chambers.

20. A microwave heating device as in claim 19 wherein the material to be heated is conveyed sequentially through the two exposure chambers.

21. A microwave heating device as in claim 19 wherein the second exposure chamber includes blocks extending at least partly along the length of the second exposure chamber from the top and bottom walls or the first and second side walls at diametrically opposed positions.

22. A microwave heating device as in claim 19 wherein the rectangular cross section of the exposure chamber is dimensioned to support $TE_{2m}$ electromagnetic waves and wherein the second exposure chamber is dimensioned to support $TE_{1n}$ electromagnetic waves.

23. A microwave heating device as in claim 1 wherein the waveguide further includes a first bend segment at the first end of the exposure chamber through which the microwave source supplies electromagnetic energy to the exposure chamber and a second bend segment at the second end of the exposure chamber, wherein the first port is formed in the first bend segment and the second port is formed in the second bend segment.

24. A microwave heating device comprising:

a waveguide defining along a portion of its length an exposure chamber;

a microwave source supplying electromagnetic energy to the exposure chamber in the form of electromagnetic waves of wavelength λ propagating along the length of the waveguide through the exposure chamber in a direction of wave propagation;

wherein the waveguide includes a top wall, a bottom wall, and first and second side walls forming in the exposure chamber a generally rectangular cross section having a width between the side walls and a height less than λ between the top and bottom walls;

wherein the exposure chamber extends along the direction of wave propagation from a first end to a second end with a first port formed in the waveguide at the first end through which material to be heated enters the exposure chamber and includes a microwave exposure region extending in length between the first port and the second end and in width from the first side wall to the second side wall in which the material to be heated is exposed to the electromagnetic energy;

wherein the first and second side walls have parallel top portions connecting to the top wall and parallel bottom portions, offset widthwise from and parallel to the top portions, connecting to the bottom wall, and wherein the distance between the top portions of the first and second side walls differs from the distance between the bottom portions, and wherein the first and second side walls are closed.

25. A microwave heating device as in claim 24 wherein the top and bottoms portions extend the full length of the exposure chamber.

26. A microwave heating device as in claim 24 wherein the top portions are separated by a distance greater than the distance between the bottom portions.

27. A microwave heating device as in claim 24 wherein the first and second side walls each include wall segments between the first and second portions forming ledges to support the material to be heated.

28. A microwave heating device as in claim 24 the exposure chamber further includes a second port formed in the second end through which the material to be heated exits the exposure chamber.

29. A microwave heating device comprising:

a waveguide defining along a portion of its length an exposure chamber;

a microwave source supplying electromagnetic energy to the exposure chamber in the form of electromagnetic waves of wavelength λ propagating along the length of the waveguide through the exposure chamber in a direction of wave propagation;

wherein the waveguide includes a top wall, a bottom wall, and first and second side walls forming in the exposure chamber a generally rectangular cross section having a width greater than or equal to λ/2 between the side walls and a height less than λ between the top and bottom walls;

wherein the exposure chamber extends in the direction of wave propagation from a first end to a second end with a first port formed through the waveguide at the first end into the exposure chamber and a second port through the waveguide at the second end into the exposure chamber to define a microwave exposure region between the first and second ports from the first side wall to the second side wall in which material to be heated is exposed to the electromagnetic energy;

a first ridge extending along at least a portion of the length of the exposure chamber from the first side wall proximate the microwave exposure region and an opposite second ridge extending from the second side wall, wherein the ridges extend inward of the side walls only a small fraction of the width of the exposure chamber to enhance the heating of the material near the first and second side walls;

wherein the first and second side walls are closed.

30. A microwave heating device as in claim 29 further comprising a conveyor extending in width from a first edge to a second edge and carrying the material to be heated in the microwave exposure region along the direction of wave propagation via the first and second ports in the exposure chamber.

31. A microwave heating device as in claim 30 further comprising:

a third ridge formed on the first side wall;

a fourth ridge formed on the second side wall opposite the third ridge;

wherein the first edge of the conveyor is disposed between the first and third ridges and the second edge of the conveyor is disposed between the second and fourth ridges.

32. A microwave heating device as in claim 30 wherein the first and second edges of the conveyor are supported in the exposure chamber on the first and second ridges.

33. A microwave heating device as in claim 30 wherein the first side wall forms an outwardly jutting first passageway extending from the first port to the second port and wherein the second side wall forms an outwardly jutting second passageway extending from the first port to the second port to receive the first and second side edges of the conveyor.

34. A microwave heating device as in claim 29 wherein the rectangular cross section of the exposure chamber is dimensioned to support multiple-mode $TE_{1n}$ electromagnetic waves, including the $TE_{1N}$ mode, where $0 \leqq n \leqq N$ and $N>0$.

35. A microwave heating device as in claim 29 wherein the rectangular cross section of the exposure chamber is dimensioned to support $TE_{1n}$ electromagnetic waves, where $n>0$.

36. A microwave heating device as in claim 29 further comprising at least one of a top ridge extending at least partly along the length of the exposure chamber from the top wall and an opposite bottom ridge extending from the bottom wall intermediately disposed between the first and second side walls to enhance the heating of the material near the first and second side walls.

37. A microwave heating device as in claim 29 further comprising at least one corner block extending along at least a portion of the length of the exposure chamber at at least one of the corners of the generally rectangular exposure chamber to enhance the heating of the material near the centerline of the conveyor.

38. A microwave heating device as in claim 29 further comprising a recess formed in the top or bottom wall of the exposure chamber and extending at least partway along the length of the exposure chamber.

39. A microwave heating device as in claim 29 further comprising a plurality of bars spaced apart along the length of the exposure chamber and extending from the first side wall to the second side wall of the exposure chamber proximate the top or bottom wall and wherein the exposure chamber is dimensioned to support $TE_{10}$ electromagnetic waves.

40. A microwave heating device as in claim 29 further comprising a plurality of bars extending from the first side wall to the second side wall of the exposure chamber and arranged between the top and bottom walls in a row traversing the direction of wave propagation and wherein the exposure chamber is dimensioned to support $TE_{10}$ electromagnetic waves.

41. A microwave heating device as in claim 29 further comprising a tapered waveguide bend segment, rectangular in cross section, disposed between the microwave source and the exposure chamber, wherein the area of the cross section is greater nearer the microwave source.

42. A microwave heating device as in claim 29 wherein the area of the cross section of the exposure chamber decreases with distance from the microwave source.

43. A microwave heating device as in claim 29 wherein the top and bottom walls of the exposure chamber converge with distance from the microwave source.

44. A microwave heating device as in claim 29 wherein the first and second side walls of the exposure chamber converge as a function of distance from the microwave source.

45. A microwave heating device as in claim 29 wherein the microwave exposure region is oblique to an imaginary plane midway between the top and bottom walls of the exposure chamber.

46. A microwave heating device as in claim 29 wherein the microwave exposure region is offset from and parallel to an imaginary plane midway between the top and bottom walls of the exposure chamber.

47. A microwave heating device as in claim 29 further comprising:

a second waveguide having a second exposure chamber; wherein the two waveguides are arranged so that the material to be heated is exposed to electromagnetic energy in both exposure chambers.

48. A microwave heating device as in claim 47 wherein the material to be heated is exposed sequentially in the first and second exposure chambers.

49. A microwave heating device as in claim 29 wherein the waveguide further includes a bend segment forming at least one of the first and second ends of the exposure chamber and through which one of the first and second ports is formed.

50. A microwave heating device comprising:

a waveguide defining along a portion of its length an exposure chamber having a generally rectangular cross section defined by top and bottom walls and first and second side walls;

a microwave source supplying electromagnetic energy to the exposure chamber in the form of electromagnetic waves propagating along the length of the waveguide through the exposure chamber in a direction of wave propagation and having electric field lines extending across the exposure chamber from the first side wall to the second side wall;

wherein the exposure chamber extends in the direction of wave propagation from a first end to a second end with a first port formed through the waveguide at the first end into the exposure chamber and a second port through the waveguide at the second end into the exposure chamber;

a conveyor conveying material through the exposure chamber generally along the direction of wave propagation via the first and second ports;

wherein the conveyor extends in width from a first edge proximate the first side wall of the exposure chamber to a second edge proximate the second side wall of the exposure chamber;

a first ridge extending along the length of the exposure chamber from the first side wall proximate the first edge of the conveyor and an opposite second ridge extending from the second side wall, wherein the ridges extend inward of the side walls only a small fraction of the width of the exposure chamber to enhance the heating of the material near the first and second side walls;

wherein the first and second side walls are closed.

51. A microwave heating device as in claim 50 further comprising:

a third ridge formed on the first side wall;

a fourth ridge formed on the second side wall opposite the third ridge;

wherein the first edge of the conveyor is disposed between the first and third ridges and the second edge of the conveyor is disposed between the second and fourth ridges.

52. A microwave heating device comprising:

a waveguide defining along a portion of its length an exposure chamber;

a microwave source supplying electromagnetic energy to the exposure chamber in the form of electromagnetic waves of wavelength $\lambda$ propagating along the length of the waveguide through the exposure chamber in a direction of wave propagation;

wherein the waveguide includes a top wall, a bottom wall, and first and second side walls forming in the exposure chamber a generally rectangular cross section having a width less than $\lambda/2$between the side walls and a height less than $\lambda$ between the top and bottom walls;

wherein the exposure chamber extends in the direction of wave propagation from a first end to a second end with a first port formed through the waveguide at the first end into the exposure chamber and a second port through the waveguide at the second end into the exposure chamber to define a microwave exposure region between the first and second ports from the first side wall to the second side wall in which material to be heated is exposed to the electromagnetic energy;

a first ridge extending along at least a portion of the length of the exposure chamber from the first side wall proximate the microwave exposure region and an opposite second ridge extending from the second side wall, wherein the ridges extend inward of the side walls only a small fraction of the width of the exposure chamber to enhance the heating of the material near the first and second side walls;

wherein the first and second side walls are closed.

53. A microwave heating device as in claim 52 further comprising a conveyor extending in width from a first edge to a second edge and carrying the material to be heated in the microwave exposure region along a conveying path in the direction of wave propagation via the first and second ports in the exposure chamber.

54. A microwave heating device as in claim 53 further comprising:

a third ridge formed on the first side wall;

a fourth ridge formed on the second side wall opposite the third ridge;

wherein the first edge of the conveyor is disposed between the first and third ridges and the second edge of the conveyor is disposed between the second and fourth ridges.

55. A microwave heating device as in claim 53 wherein the first and second edges of the conveyor are supported in the exposure chamber on the first and second ridges.

56. A microwave heating device as in claim 52 wherein the microwave exposure region is oblique to an imaginary plane midway between the top and bottom walls of the exposure chamber.

57. A microwave heating device as in claim 52 wherein the microwave exposure region is offset from and parallel to an imaginary plane midway between the top and bottom walls of the exposure chamber.

* * * * *